United States Patent [19]

Koller

[11] 4,005,322

[45] Jan. 25, 1977

[54] ROTATING ANODE TARGET STRUCTURE

[75] Inventor: Thomas J. Koller, Huntington, Conn.

[73] Assignee: The Machlett Laboratories, Incorporated, Stamford, Conn.

[22] Filed: Mar. 8, 1976

[21] Appl. No.: 664,832

[52] U.S. Cl. ..... 313/60; 313/330

[51] Int. Cl.[2] ..... H01J 35/08

[58] Field of Search ..... 313/330, 60

[56] References Cited

UNITED STATES PATENTS

| | | | |
|---|---|---|---|
| 3,790,838 | 2/1974 | Baum | 313/330 X |
| 3,801,847 | 4/1974 | Dietz | 313/330 X |
| 3,851,204 | 11/1974 | Rollfinke | 313/330 |

*Primary Examiner*—Rudolph V. Rolinec
*Assistant Examiner*—Darwin R. Hostetter
*Attorney, Agent, or Firm*—Harold A. Murphy; Joseph D. Pannone; John T. Meaney

[57] ABSTRACT

A rotating anode target for X-ray tubes comprising a substrate disc provided with an annular marginal portion having opposed bevel surfaces convergent toward an outer peripheral edge of the disc, one of the surfaces being coated with a layer of X-ray emissive material which extends around the peripheral edge and terminates in an annular feathered edge merging with the opposed bevel surface of the disc.

9 Claims, 8 Drawing Figures

ROTATING ANODE TARGET STRUCTURE

BACKGROUND OF THE INVENTION

1. Field of the Invention

This invention relates generally to rotating anode X-ray tubes and is concerned more particularly with a coated anode target having improved resistance to deformation.

2. Discussion of the Prior Art

Generally, a rotatable anode X-ray tube comprises a tubular envelope having rotatably mounted therein an anode target disc provided with an annular marginal portion called the focal track. The focal track usually is made of a relatively high atomic number material, such as tungsten, for example, which readily emits X-rays when bombarded by high energy electrons. An axially spaced cathode is disposed to direct a beam of high energy electrons onto an aligned focal spot area of the focal track thereby generating X-rays which emanate therefrom. The focal track portion of the anode disc generally is disposed at a predetermined target angle with respect to the plane of the disc, such that the focal spot area is inclined toward a radially aligned, X-ray transparent window in the tube envelope. Consequently, the X-rays passing in a beam through the X-ray transparent window appear to be emanating from a radial projection of the focal spot area, which generally is called the "focal spot" of the tube.

Most of the electron energy incident on the focal spot area of the focal track is converted to heat which is manifested by a sharp increase in the temperature of the target material. For example, the surface temperature of the focal spot area may rise as high as 3000° C. Therefore, in order to avoid pitting or otherwise damaging the focal track surface, the anode disc is rotated at suitably high angular velocities, such as 10,000 RPM, for example, to move successive segments of the focal track rapidly through the focal spot area aligned with the electron beam. In order to reduce inertia when attaining the desired high angular velocities, the anode target may comprise a lightweight disc substrate made of a material, such as molybdenum or graphite, for examples, having a comparatively high heat capacity. Also, the focal track may comprise a layer of X-ray emissive material coating the annular marginal portion of the disc adjacent the electron emitting cathode. Thus, the heat generated in the focal track layer may be transferred to the high heat capacity substrate and ultimately dissipated through the supporting structure of the anode disc.

However, it has been found that despite these developments the anode disc still may become distored during high temperature operation. Generally, the annular marginal portion of the disc may bend in the direction of the cathode so as to decrease the target angle thereby decreasing the field coverage of the X-ray beam. It is believed that centrifugal forces due to the high angular velocities attained by the disc and thermal differences in expansion between the focal track layer and the disc induce stresses in the focal track layer. These stresses are relieved by distortion or deformation of the annular marginal portion of the disc, as described.

Therefore, it is advantageous and desirable to provide a rotating anode X-ray tube with a coated target substrate having means for relieving thermomechanical stresses induced therein by centrifugal forces and high thermal loads.

SUMMARY OF THE INVENTION

Accordingly, this invention provides a rotating anode X-ray tube comprising a tubular envelope wherein an electron emitting cathode is disposed in spaced relationship with a focal track surface of a rotatable anode target. The anode target includes a substrate disc provided with an annular marginal portion having opposed bevel surfaces convergent toward an outer peripheral edge of the disc. The bevel surface adjacent the cathode is coated with a focal track layer of X-ray emissive material, such as tungsten or tungsten-rhenium alloy, for examples. The focal track layer extends around the outer peripheral edge of the disc and terminates in an annular feathered edge which merges with the opposed bevel surface of the disc. Thus, there is provided an extremely thin terminal edge of the layer having the required thermal expansion and contraction characteristics along with the desired mechanical flexibility for relieving thermomechanical stresses induced in the layer by centrifugal forces and high thermal loads. By extending the focal track layer around the outer peripheral edge of the disc a continuous path is provided for conducting the thermomechanical stresses from the focal track to the ultra thin terminal edge of the layer on the cooler surface of the anode disc.

The substrate disc preferably is made of a relatively lower atomic number material, such as molybdenum or graphite, for examples, having a higher heat capacity as compared to the X-ray emissive material of the focal track layer. The opposed bevel surfaces of the disc may be disposed at respective angles of inclination relative to the transverse plane of the disc suitable for balancing opposing axially directed forces acting thereon. Thus, the disc substrate may comprise a symmetrical body having opposed bevel surfaces inclined at equal but opposite angles with respect to the transverse plane of the disc, such that in cross-sectional view the opposed bevel surfaces appear as mirror images of one another. Alternatively, the disc substrate may comprise an assymmetrical body having opposed bevel surfaces disposed at opposite angles of different magnitudes with respect to the transverse plane of the disc. Also, the focal track layer on the bevel surface adjacent the cathode and the extension of the layer on the opposing bevel surface may be provided with respective thicknesses suitable for balancing opposing axially directed forces acting thereon. Thus, adjacent the peripheral edge of the disc, the focal track layer and the extension thereof may be of uniform thicknesses. Alternatively, adjacent the peripheral edge of the disc, the focal track layer may be thicker or thinner than the extension thereof on the opposing bevel surface.

BRIEF DESCRIPTION OF THE DRAWING

For a better understanding of the invention, reference is made in the following more detailed description to the accompanying drawings wherein.

DESCRIPTION OF THE PREFERRED EMBODIMENT

Figure 1:
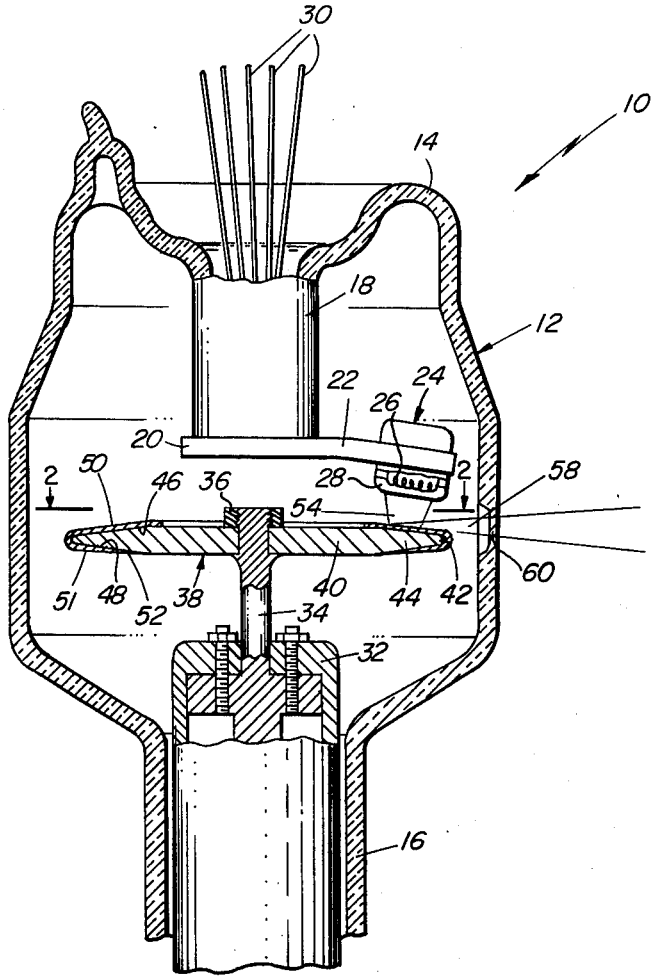
FIG. 1 is a fragmentary elevational view, partly in axial section, of an X-ray tube embodying the invention.

Referring to the drawing wherein like characters of reference designate like parts, there is shown in FIG. 1 an X-ray tube 10 of the rotating anode type having a tubular envelope 12 made of dielectric material, such as glass, for example. Envelope 12 is provided with a reentrant end portion 14 and an opposing neck portion 16. The reentrant end portion of envelope 12 is peripherally sealed to one end of a cathode support sleeve 18 made of rigid material, such as Kovar, for example. Cathode sleeve 18 extends axially within the envelope 12 and has an inner end hermetically sealed to a cap 20 which supports a radially extending, hollow arm 22.

The arm 22 is angulated with respect to the axis of cathode sleeve 18 and supports on a distal end portion thereof a conventional cathode head 24. Cathode head 24 generally includes an electron emitting filament 26 which is longitudinally disposed within a grid-type focusing cup 28. Electrical conductors 30 extend hermetically through the cap 20 and insulatingly through the hollow arm 22 for suitable connection to the filament 26 and the focusing cup 28 in a well-known manner.

Sealed within the neck portion 16 of envelope 12 is a bearing mounted rotor 32 of a magnetic-type induction motor, (the external stator of which is not shown). The rotor 32 extends axially within envelope 12 and has attached to its inner end an axially extending stem 34. Suitably secured, as by hex nut 36, for example, to a distal end portion of stem 34 is a transversely disposed anode target 38, which is rotated by the rotor 32 in a well-known manner. The anode target 38 includes a substrate disc 40 having adjacent its outer peripheral edge 42 an annular marginal portion 44 provided with opposed bevel surfaces, 46 and 48 respectively.

Figure 2:
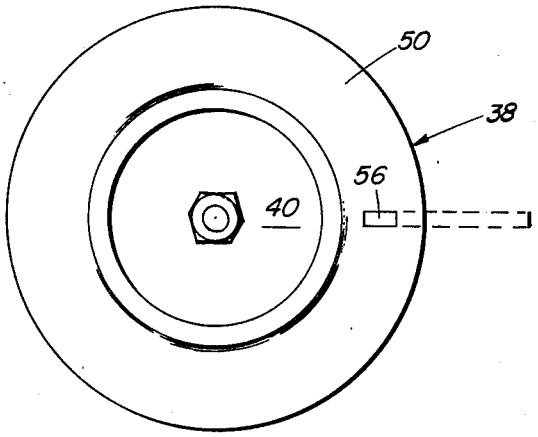
FIG. 2 is a plan view of the anode target disc taken along line 2—2 in FIG. 1 and looking in the direction of the arrows.

The bevel surface 46, as shown in FIG. 2, is coated with a focal track layer 50 of X-ray emissive material, a portion of which is disposed in spaced opposing relationship with the cathode head 24. The layer 50 may comprise any suitable X-ray emissive material, such as tungsten or tungsten-rhenium alloy, for examples, which may be applied to the bevel surface 46 by convenient means, such as chemical vapor deposition, for example. Layer 50 also extends continuously around the peripheral edge 42 of disc 40 and includes an extension layer 51 which is deposited on the opposed bevel surface 48. The extension layer 51 terminates in an annular feather edge 52 which merges with the adjacent bevel surface 48. Thus, the sloping configuration of the opposed bevel surface 48 provides means for obtaining the desired feather edge 52 without need of masking or of subsequent machining.

In operation, electrical energy supplied through the conductors 30 heats the filament 26 to electron emitting temperature, and maintains the focusing cup 28 at a suitable electrical potential for directing the emitted electrons into a beam 54. The anode target 38 is rotated at an appropriate high angular velocity, such as 10,000 RPM, for example, for rapidly changing the arcuate portion of focal track layer 50 in spaced alignment with the cathode head 24. Also, the target 38 is maintained at a sufficiently high electrical potential with respect to the filament 26 for accelerating electrons in the beam 54 onto an aligned focal spot area 56 of the focal track 50.

The resulting high energy electrons impinging on the focal spot area 56 generate X-rays, some of which pass in a beam 58 through a radially aligned, X-ray transparent window 60 in the tube envelope 12. Consequently, the X-ray beam 58 appears to be emanating from a radial projection of the focal spot area 56, commonly called the "focal spot" of the tube. Thus, if the focal spot area 56 is generally rectangular in configuration, the focal spot usually is a substantially square area, which may be as small three square millimeters in size, for example. Accordingly, the focal spot of the tube generally approximates a point source for the X-ray beam 58, in order to enhance resolution in radiographic images produced by the beam.

Figure 3A:
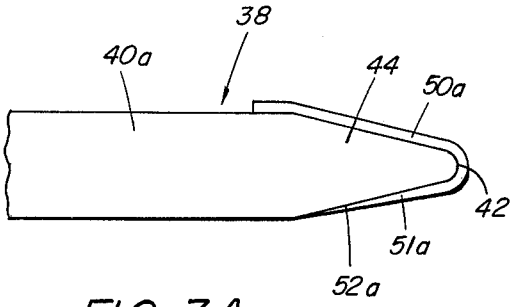
FIGS. 3*a*–3*c* are fragmentary axial sectional views of a symmetrical target disc having various focal track layer thicknesses as compared to extensions thereof on the opposing bevel surface of the disc.
Figure 3B:
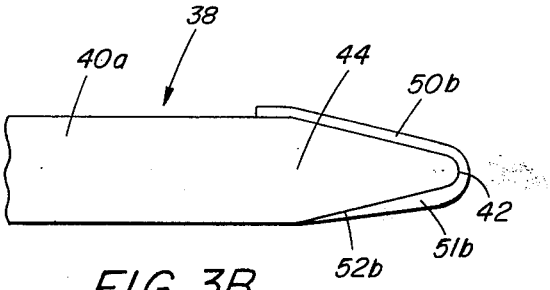
Figure 3C:
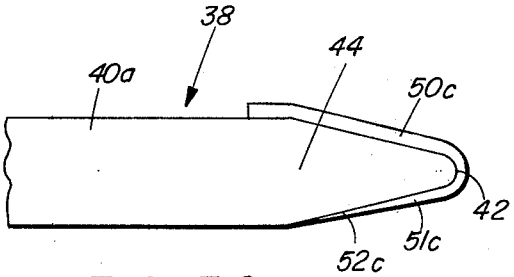

Thus, the bevel surfaces 46 and 48 of disc 40 are subjected to respective opposing axial components of a centrifugal force developed by the high angular velocity of anode target 38. Consequently, the disc 40, as shown in FIGS. 3*a*–3*c*, may comprise a symmetrical body 40*a* having opposing bevel surfaces 46*a* and 48*a* disposed at respective equal but opposite angles relative to a transverse plane extending through the peripheral edge 44. In this manner, the opposing axial components of the centrifugal force acting on the respective bevel surfaces 46*a* and 48*a* may be balanced.

Similarly, the focal track layer 50 and the extension layer 51 are subjected to respective opposing axial components of the centrifugal force which tend to lift the layers from the adjacent bevel surfaces 46 and 48, respectively. Consequently, as shown in FIG. 3*a*, a focal track layer 50*a* and an annular portion of extension layer 51*a* adjacent the peripheral edge 42 may be provided with substantially uniform thicknesses. In this manner, the respective opposing axial components of the centrifugal force acting on the layers 40*a* and 51*a* may be balanced. Alternatively, as shown in FIG. 3*b*, an annular portion of an extension layer 51*b* adjacent the peripheral edge 42 may be provided with a greater thickness than the thickness of focal track layer 50*b*. On the other hand, as shown in FIG. 3*c*, an annular portion of an extension layer 51*c* may be provided with a lesser thickness than the thickness of focal track layer 50*c*. In this manner, forces other than the axial components of the centrifugal forces acting on the respective layers 50 and 51 may be counterbalanced.

Generally, the coefficients of thermal expansion for X-ray emissive materials of the focal track 50 are considerably less than the higher heat capacity materials of the disc 40. For example, the thermal coefficient of expansion for tungsten is about one-half the thermal coefficient of expansion for molybdenum. Consequently, a bimetallic effect is produced by disc 40 tending to expand thermally in the radial direction a greater amount than the focal track layer 50. As a result, rotating anodes of the prior art generally are deformed by the annular portion 44 of the anode target 38 bending axially in the direction of the cathode head 24. However, distortion of the described type is avoided in the rotating anode target of this invention, by extending the focal track layer 50 around the peripheral edge 42 of disc 40 to form the extension layer 51 having a terminal annular feather edge 52 which merges with the relatively cooler bevel surface 48 of the disc. Thus, the focal track 50 and the thermally connected extension layer 51 tend to restrict the radial expansion of disc 40. It is believed that the resulting thermal and mechanical stresses induced in the focal track layer 50 and the continuously connected extension layer 51 are relieved through the terminal annular feather edge 52 of extension layer 51. Because of its tapering thinness, the feather edge 52 is enabled to match closely the thermal expansion and mechanical characteristics of the adjacent bevelled surface 48 of disc 40.

Figure 4A:
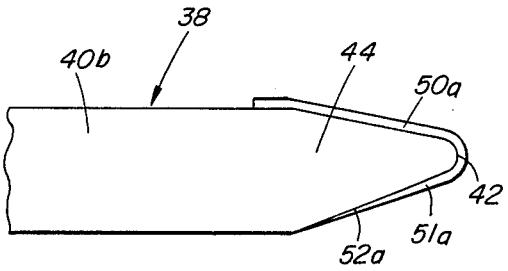
FIGS. 4*a*–4*c* are fragmentary axial sectional views of an assymetrical target disc having various focal track layer thicknesses as compared to extensions thereof on the opposing bevel surface of the disc.
Figure 4B:
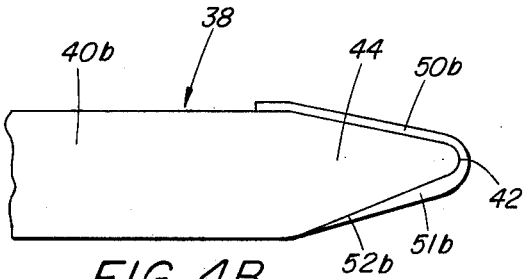
Figure 4C:
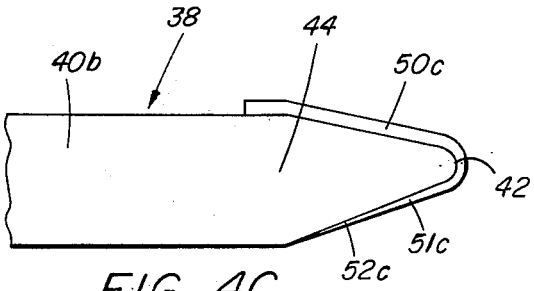

Alternatively, as shown in FIGS. 4*a*–4*c*, the anode target 38 may comprise an assymmetrical disc 40*b* having respective bevel surfaces 46 *b* and 48*b* disposed at opposite angles of different magnitude with respect to a transverse plane passing through the peripheral edge 42. Therefore, since the bevel surface 46*b* is subjected to a greater thermal loading, the opposed bevel surface 48*b* may be disposed at a greater angle with respect to the transverse plane passing through the peripheral edge 44. Thus, the stronger axial components of the centrifugal force acting on the bevel surface 48*b* may compensate for the lesser axial components of the centrifugal force acting on the bevel surface 46*b* and for the thermal stresses induced therein, as by the previously described bimetallic effect, for example. Also, the bevel surfaces 46*b* and 48*b*, as shown in FIG. 4*a*, may be coated with a focal track layer 50*a* and extension layer 51*a*, respectively, which have respective annular portions of substantially uniform thicknesses adjacent the peripheral edge 44. On the other hand, as shown in FIG. 4*b*, the annular portion of an extension layer 51*b* adjacent the peripheral edge 44 may be provided with a greater thickness than the thickness of a focal track layer 50. In lieu thereof, as shown in FIG. 4*c*, an annular portion of an extension layer 51*c* may be provided with a lesser thickness than the thickness of a focal track layer 50*c*.

Thus, there has been disclosed herein an X-ray anode target of the rotating type comprising a substrate disc having an annular portion provided with opposed bevel surfaces convergent toward the outer peripheral edge of the disc, one bevel surface being coated with a focal track layer which extends around the peripheral edge and forms an extension layer having an annular feathered edge merging with the opposed bevel surface of the disc.

From the foregoing, it will be apparent that all of the objectives of this invention have been achieved by the structures shown and described. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. An X-ray target of the rotating anode type comprising:

a disc having an annular marginal portion disposed adjacent an outer peripheral edge and provided with opposed bevel surfaces convergent toward the edge; and a focal track layer of X-ray emissive material disposed annularly on one of the bevel surfaces and extended around the peripheral edge to terminate on the other bevel surface in a feather edge.

2. An X-ray target as set forth in claim 1 wherein the disc is made of a higher heat capacity material than the X-ray emissive material.

3. An X-ray target as set forth in claim 1 wherein the disc is a symmetrical body.

4. An X-ray target as set forth in claim 1 wherein the disc is an assymmetrical body.

5. An X-ray tube of the rotating anode type comprising:

a tubular envelope;

an anode target rotatably disposed within the envelope and including a disc having an annular marginal portion adjacent its outer peripheral edge provided with opposed bevel surfaces convergent toward the peripheral edge;

a focal track layer of X-ray emissive material disposed annularly on one of the bevel surfaces and extended around the peripheral edge to terminate on the other bevel surface in an annular feather edge; and cathode means disposed within the envelope for directing an electron beam onto a portion of the focal track layer.

6. An X-ray tube as set forth in claim 5 wherein the anode target disc is made of a higher heat capacity material than the X-ray emissive material.

7. An X-ray tube as set forth in claim 5 wherein the disc is a symmetrical body.

8. An X-ray tube as set forth in claim 5 wherein the disc is an assymmetrical body.

9. An X-ray tube as set forth in claim 8 wherein said one bevel surface is disposed at a smaller magnitude angle with respect to a transverse plane through the peripheral edge than said other bevel surface.

* * * * *